US005303456A

United States Patent [19]

Mussell

[11] Patent Number: 5,303,456

[45] Date of Patent: Apr. 19, 1994

[54] OPEN SPRING SAFETY PIN

[76] Inventor: Michal A. Mussell, 213 N. Lapham, Pittsburg, Kans.

[21] Appl. No.: 12,351

[22] Filed: Feb. 2, 1993

[51] Int. Cl.[5] ..... A44B 9/00

[52] U.S. Cl. ..... 24/710; 24/710.2; 24/711.3

[58] Field of Search ..... 24/710, 710.1, 710.2, 24/710.3, 711.3

[56] References Cited

U.S. PATENT DOCUMENTS

| | | | |
|---|---|---|---|
| 1,141,952 | 6/1915 | Faulks . | |
| 1,170,508 | 2/1916 | Boye . | |
| 1,174,485 | 3/1916 | Franklin . | |
| 1,501,627 | 7/1924 | Silverman . | |
| 1,623,532 | 4/1927 | Dudas et al. . | |
| 2,416,644 | 2/1947 | Rundell | 24/710 |
| 2,748,438 | 6/1956 | Clark | 24/710 |
| 2,971,235 | 2/1961 | Benoit | 24/710 |

FOREIGN PATENT DOCUMENTS

| | | | |
|---|---|---|---|
| 0023414 | of 1902 | United Kingdom | 24/710.3 |
| 0202178 | 8/1923 | United Kingdom | 24/710 |
| 0296426 | 10/1928 | United Kingdom | 24/710 |

*Primary Examiner*—Victor N. Sakran
*Attorney, Agent, or Firm*—Richard C. Litman

[57] ABSTRACT

A safety pin having an axially extending coil type torsion spring, thereby avoiding pinching fabric to which it is attached. Alternative embodiments provide arrangements assuring alignment of the wire sections of the safety pin with the head. In one alternative embodiment, the wire sections of the safety pin bend toward the middle of the spring, and enter the head in parallel orientation. In a second embodiment, the head is angled with respect to the coil spring, and the wire sections form a V relative to one another.

1 Claim, 1 Drawing Sheet

OPEN SPRING SAFETY PIN

BACKGROUND OF THE SUMMARY

1. FIELD OF THE INVENTION

The present invention relates to an improvement to a safety pin, the improvement being specifically that the coils of the torsion spring are spaced apart so as not to entrap fabric threads therein.

2. DESCRIPTION OF THE PRIOR ART

The problem of a safety pin pinching threads of a fabric in the torsion spring has long been recognized in the prior art. U.S. Pat. No. 1,170,508, issued to James H. Boye on Feb. 8, 1916; U.S. Pat. No. 1,501,627, issued to Nathaniel L. Silverman on Jul. 15, 1924; and U.S. Pat. No. 1,623,532, issued to Andrew Dudas et al. on Apr. 5, 1927 all disclose structure provided to prevent pinching of fabric in a safety pin. Boys bends the straight sections of the pin as they extend from the spring coils, forming concavities which ward off fabric that might otherwise be pinched in a crevice that would ordinarily be defined between one straight section and a coil. Silverman provides a stop formed by a band, recited in the specification but not illustrated, which prevents fabric from advancing into such intimate relation therewith so as to become enmeshed with the coil. Dudas forms a bend in the coil serving as a stop, which bend is clearly illustrated in the drawings.

U.S. Pat. No. 1,174,485, issued to Mason B. Franklin on Mar. 7, 1916, discloses a pin having a conventional coil spring. The spring is illustrated as being axially extended, but no further details are provided in the discussion of the invention. An open receptacle for holding the pointed end is formed by bending the wire at the other end of the pin, and this open receptacle has great width compared to the ordinarily employed, U-shaped head or sheath. The open coil spaces apart straight segments of wire to enable the sharp member of the pin to be centered in the receptacle. The issue of pinching the fabric being retained is not addressed by Franklin.

U.S. Pat. No. 1,141,952, issued to Chelcias E. Faulks on Jun. 8, 1915, discloses a pin which separates two pieces of cloth so that one may be released while maintaining attachment to the second. This is accomplished by a stop formed by a bend in the pin.

None of the above inventions and patents, taken either singly or in combination, is seen to describe the instant invention as claimed.

SUMMARY OF THE INVENTION

A safety pin having a conventional U-shaped head or sheath is provided with a coil spring which is expanded axially, whereby the coils are spaced apart. A gap thus created provides less tendency to pinch a fabric to which the safety pin is attached. In a first alternative embodiment, the wire sections of the safety pin bend toward the middle of the spring, and enter the head in parallel orientation. In a second alternative embodiment, the head is angled with respect to the coil spring, and the wire sections form a V relative to one another.

Accordingly, it is a principal object of the invention to provide a safety pin including a torsion spring having coils spaced apart whereby to reduce tendency of a fabric being secured to the safety pin to be pinched therein.

It is another object of the invention to provide a safety pin having means to defeat pinching of a fabric provided which means avoid incorporation of minimal additional structure.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figures 1, 2, 3, 4:
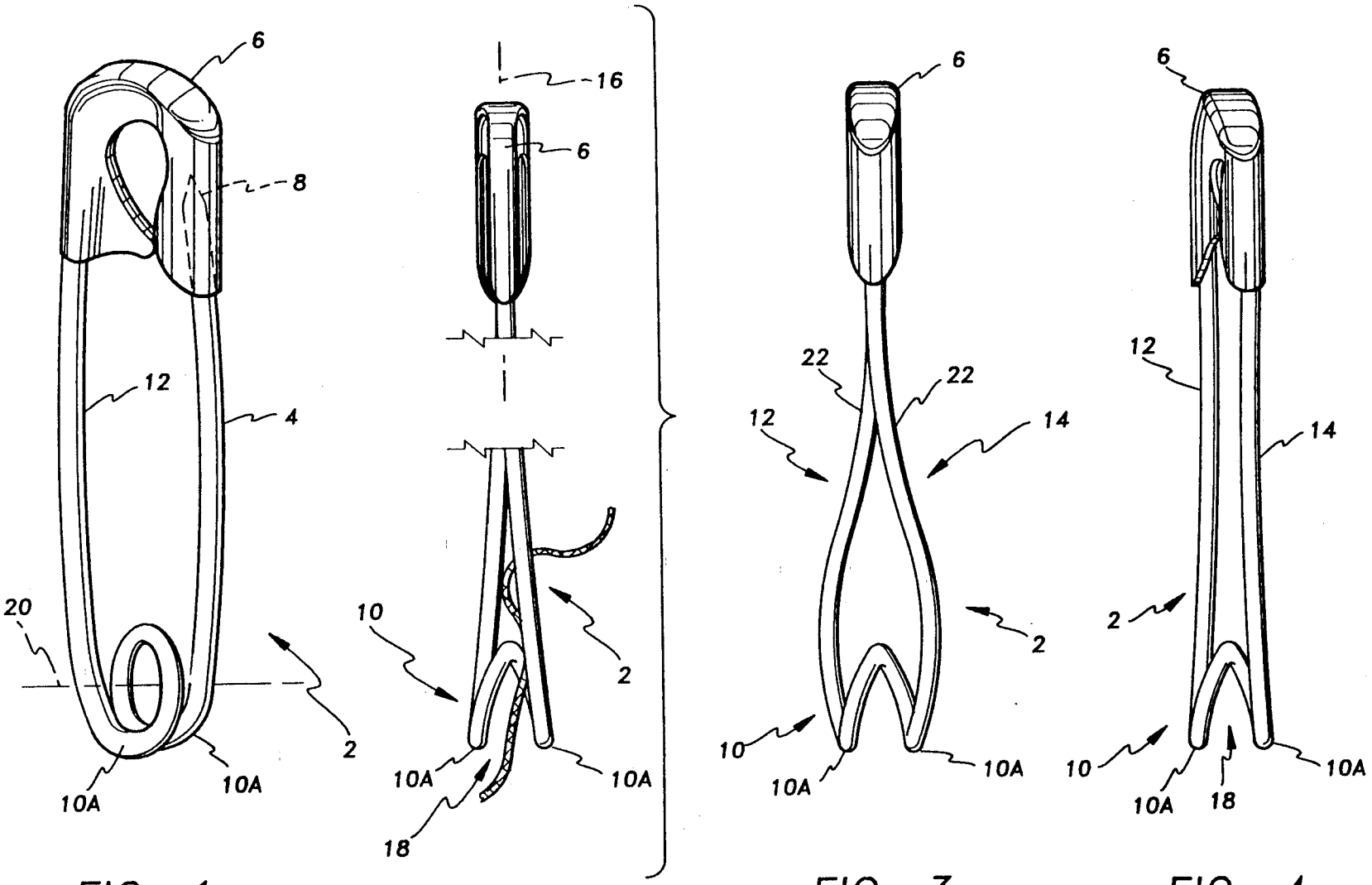
FIG. 1 is a perspective view of the invention.
FIG. 2 is a partial front elevational view of the coil spring.
FIG. 3 is a front elevational view of a first embodiment of the invention.
FIG. 4 is a front elevational view of a second embodiment of the invention.

The novel safety pin 2, seen in FIG. 1, generally comprises a straight, sharp, pointed piercing member or rod 4 which penetrates a layer of fabric F being secured by the safety pin 2, a head 6 for retaining and partially enclosing the sharp, pointed end 8 of the piercing rod 4 a torsion spring 10, and a straight support wire or rod 12 connecting the head 6 to the torsion spring 10 in spaced relation. Better seen in FIG. 2, the head 6 has two major lateral faces 14,14, and is sufficiently thin to describe a major plane 16 between the two lateral faces 14,14. This major plane 16 is illustrated at line A—A. When the safety pin 2 is closed, thus retaining the piercing member 4, the support rod 12 and the piercing member 4 are substantially parallel to one another and are disposed within the major plane 16 defined by the head 6.

It has been general practice in the prior art to form the torsion spring from a coiled section of wire rod employed to construct the safety pin, the coiled spring being compressed to maintain a flat, compact configuration. Safety pins thus formed work well, but have a tendency to trap or pinch a thread or fold of fabric between an arcuate section of the coil spring and an adjacent straight section of the piercing rod or support rod. The fabric secured by the safety pin is thus susceptible to damage, as by the thread or fold of fabric being pulled from the rest of the fabric. This damage threatens an entire fabric article as most fabrics will progressively unravel once the first thread is torn or loosened.

This problem is addressed in the present invention by expanding the coil spring 10 axially so that any one arcuate section 10A thereof is spaced apart from another arcuate section 10A, defining a gap 18 therebetween. Chances of entrapping a thread or fold of fabric in this gap 18 are substantially reduced when compared to prior art safety pins.

The expanded coil spring 10 defines an axis 20, shown in FIG. 1. Since the coil spring 10 of the novel safety pin 2 is axially extended, the support rod 12 and the piercing rod 4 are no longer substantially coplanar, as in the prior art. Now, they are offset by the axial dimension of the coil spring 10, and resultant altered interface between the sharp, pointed end 8 of the piercing rod 4 and the head 6 is accommodated in either of two ways. In a first embodiment, shown in FIG. 3, the head major plane 16 (see FIG. 2) is normal to the axis 20 of the coil spring 10. Either or both of the support rod 12 and the piercing rod 4 includes a bend 22, enabling the support and piercing rods 12 and 4 to originate at the coil spring 10, but to project toward the head 6 from directly therebelow, in the manner of the prior art safety pins.

In a second embodiment, as illustrated in FIG. 4, the head 6 is printed on the support rod 12 so that is major plane 16 is disposed at an angle or twisted with respect to the axis 20 of the coil spring 10. In this manner, the piercing rod 4 and support rod 12 occupy the head major plane 16, and accommodation of the piercing rod 4 by the head 6 as for fastening is facilitated. It is emphasized that FIG. 4 is a true front elevational view, clearly showing the angle offset or twist of head 6 with respect to a plane perpendicular to axis 20 (see FIG. 1) of coil spring 10. The tendency of a safety pin to damage a fabric article is thus reduced, and minimal complexity and cost are entailed in the novel arrangement presented herein.

It is to be understood that the present invention is not limited to the embodiments described above, but encompasses any and all embodiments within the scope of the following claims.

I claim:

1. A safety pin, comprising in combination:

support rod means, piercing rod means, head means, and coil spring means, said support rod means connecting said head means in spaced relation to said coil spring means, said piercing rod means being pivotally fixed to said coil spring means and separably engageable with said head means, said coil spring means having an axis and defining arcuate sections therein, each said arcuate section being axially spaced apart from another said arcuate section, wherein each portion of said coil spring means is spaced apart from very other portion thereof, said head means includes two substantially parallel sides, defining a major plane therebetween, wherein said head means major plane is angled with respect to said coil spring means axis, whereby said support rod means diverges tangentially and perpendicularly from said coil spring means and said piercing rod means diverges from said coil spring means at an angle thereto, and both said support rod means and said piercing rod means are coplanar when retained within said head means, and whereby the structural arrangement of said head means being angled with respect to the coil spring means and said piercing rod means and said support rod means occupy the head major plane whereby the damage to a fabric is reduced.

* * * * *